US006766776B2

(12) United States Patent
Jiang et al.

(10) Patent No.: US 6,766,776 B2
(45) Date of Patent: Jul. 27, 2004

(54) CONTROL METHOD FOR PREVENTING INTEGRATOR WIND-UP WHEN OPERATING VCT AT OR NEAR ITS PHYSICAL STOPS

(75) Inventors: Zhenyu Jiang, Ithaca, NY (US); Earl Ekdahl, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/285,854

(22) Filed: Nov. 1, 2002

(65) Prior Publication Data

US 2003/0230261 A1 Dec. 18, 2003

Related U.S. Application Data

(60) Provisional application No. 60/389,192, filed on Jun. 17, 2002.

(51) Int. Cl.[7] ..... F01L 1/34

(52) U.S. Cl. ..... 123/90.15; 123/90.17

(58) Field of Search ..... 361/152, 154, 361/160; 123/90.15, 90.16, 90.17

(56) References Cited

U.S. PATENT DOCUMENTS

| | | | | |
|---|---|---|---|---|
| 5,002,023 A | | 3/1991 | Butterfiled et al. | 123/90.15 |
| 5,107,804 A | | 4/1992 | Becker et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,289,805 A | | 3/1994 | Quinn, Jr. et al. | 123/90.17 |
| 5,361,735 A | | 11/1994 | Butterfield et al. | 123/90.17 |
| 5,497,738 A | | 3/1996 | Siemon et al. | 123/90.17 |
| 5,657,725 A | | 8/1997 | Butterfield et al. | 123/90.17 |
| 6,109,225 A | * | 8/2000 | Ogita et al. | 123/90.15 |
| 6,213,070 B1 | * | 4/2001 | Hashimoto et al. | 123/90.15 |
| 6,216,655 B1 | * | 4/2001 | Yoshiki et al. | 123/90.15 |
| 6,240,359 B1 | * | 5/2001 | Fujiwara et al. | 701/114 |
| 6,247,434 B1 | | 6/2001 | Simpson et al. | 123/90.17 |
| 6,250,265 B1 | | 6/2001 | Simpson et al. | 123/90.17 |
| 6,263,846 B1 | | 7/2001 | Simpson et al. | 123/90.17 |
| 6,311,655 B1 | | 11/2001 | Simpson et al. | 123/90.17 |
| 6,352,061 B2 | * | 3/2002 | Takahashi | 123/90.15 |
| 6,374,787 B2 | | 4/2002 | Simpson et al. | 123/90.17 |
| 6,477,999 B1 | | 11/2002 | Markeley | 123/90.17 |
| 6,516,759 B2 | * | 2/2003 | Takahashi et al. | 123/90.15 |

* cited by examiner

*Primary Examiner*—Thomas Denion
*Assistant Examiner*—Jaime Corrigan
(74) *Attorney, Agent, or Firm*—Brown & Michaels PC; Greg Dziegielewski

(57) ABSTRACT

In a VCT system, a method uses a controller to automatically determine a state of a phaser based on an identifier. The identifier identifies a filtered signal of the crank shaft and cam shaft and uses the same to identify the phaser state. A reset signal is generated by the identifier to reset the VCT system, specifically to reset a control law whereby the unnecessary information retained by the VCT system is cleared. Therefore, the controller is able to promptly and accurately determine the phaser position and state.

8 Claims, 11 Drawing Sheets

CONTROL METHOD FOR PREVENTING INTEGRATOR WIND-UP WHEN OPERATING VCT AT OR NEAR ITS PHYSICAL STOPS

REFERENCE TO RELATED APPLICATIONS

This application claims an invention which was disclosed in Provisional Application No. 60/389,192, filed Jun. 17, 2002, entitled "CONTROL METHOD FOR PREVENTING INTEGRATOR WIND-UP WHEN OPERATING VCT AT OR NEAR ITS PHYSICAL STOPS". The benefit under 35 USC §119(e) of the U.S. provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention pertains to a control method which prevents integrator wind-up when operating VCT at or near its physical stops.

2. Description of Related Art

It is known in the art to use a negative feedback loop for controlling variable camshaft timing (VCT) systems. U.S. Pat. No. 5,289,805 describes an improved closed loop feedback system for a VCT system. The same patent further teaches a robust control law used in the closed loop feedback system for a VCT system. The control law includes a phase integration (PI) block and a phase lead block. FIGS. 1 and 2 show the feedback loop and the control law respectively.

Referring to FIG. 1, a prior art feedback loop 10 is shown. The control objective of feedback loop 10 is to have the VCT phaser at the correct phase (set point 12) and the phase rate of change is zero. In this state, the spool valve 14 is in its null position and no fluid flows between two fluid holding chambers of a phaser (not shown). A computer program product which utilizes the dynamic state of the VCT mechanism is used to accomplish the above state.

The VCT closed-loop control mechanism is achieved by measuring a camshaft phase shift .$\theta_0$ 16, and comparing the same to the desired set point r 12. The VCT mechanism is in turn adjusted so that the phaser achieves a position which is determined by the set point r 12. A control law 18 compares the set point 12 to the phase shift $\theta_0$ 16. The compared result is used as a reference to issue commands to a solenoid 20 to position the spool 14. This positioning of spool 14 occurs when the phase error (the difference between set point r 12 and phase shift 20) is non-zero.

The spool 14 is moved toward a first direction (e.g. right) if the phase error is positive (retard) and to a second direction (e.g. left) if the phase error is negative (advance). When the phase error is zero, the VCT phase equals the set point r 12 so the spool 14 is held in the null position such that no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase difference is defined as the time from successive crank-to-cam pulses, divided by the time for an entire revolution and multiplied by 360°. In other words, the angular position difference is referenced to the difference between the cam shaft and the crank shaft with and without the Variable Cam Timing system. The measured phase difference may be expressed as $\theta_0$ 16. This phase difference is then supplied to the control law 18 for reaching the desired spool position.

A control law 18 of the closed-loop 10 is described in U.S. Pat. No. 5,184,578 and is hereby incorporate herein by reference. A simplified depiction of the control law is shown in FIG. 2. Measured phase 26 is subjected to the control law 18 initially at block 30 wherein proportional-integral (PI) process occurs. Typically PI process is subdivided into two sub-processes. The first sub-process includes an amplification action; and the second sub-process includes an integration action. Measured VCT phase is further subjected to phase compensation at block 32. One of the drawbacks of the above prior art approach is that at or near the physical stops of the phaser, the prior art method cannot accurately indicate the exact physical position of the phaser. One of the undesirable side effects is that the Integrator of the control law would wind-up. This phenomenon often occurs when an internal combustion engine system goes under prolonged use in which physical components may change their characteristics. For example, the timing chain may be stretched.

Therefore, it is desirable to provide a control method and system, which prevents integrator wind-up when operating VCT phaser at or near its physical stops.

SUMMARY OF THE INVENTION

A method involving a VCT phaser to automatically learn VCT phaser physical stops while the engine is running is provided.

A method involving a VCT phaser for eliminating integrator winding up is provided.

A method involving a VCT phaser for learning a value of a PI controller output (E1) at steady state is provided.

A method involving a VCT phaser for learning a value of a PI controller output (E1) at physical stops is provided.

A method involving a VCT phaser which determines when to reset an integrator if the phaser approaches its physical stops is provided.

A method involving a VCT phaser which determines when to reset a compensator if the phaser approaches its physical stops is provided.

A method involving a VCT phaser to self correct a mistakenly learned physical stop is provided.

A computer program product involving a VCT phaser, which can automatically learn VCT physical stops while engine is running, is provided.

A computer program product involving a VCT phaser for eliminating integrator winding up is provided.

A computer program product involving a VCT phaser for learning a value of a PI controller output (E1) at steady state is provided.

A computer program product involving a VCT phaser for learning a value of a PI controller output (E1) at physical stops is provided.

A computer program product involving a VCT phaser which determines when to reset an integrator if the phaser approaches its physical stops is provided.

A computer program product involving a VCT phaser which determines when to reset a compensator if the phaser approaches its physical stops is provided.

A computer program product involving a VCT phaser to self correct a mistakenly learned physical stop is provided.

Accordingly, a method for a VCT feed back control system is provided. The method includes the steps of: a) providing a set of tooth pulses; b) filtering said set of tooth pulses; c) identifying a phaser that is not moving; d) determining whether the non-moving phaser is at stop state or steady state; and e) learning the phaser physical stop.

Accordingly a VCT feed back control system is provided. The system includes: a) a variable force solenoid; b) a spool valve capable of being engaged by said solenoid; c) a VCT phaser disposed to determine a set of positions, wherein a set of relationships between a crank shaft and cam shaft is determined, said VCT phaser being controllable by positions of said spool; and d) a controller. The controller includes a control law disposed to receive a set point and capable of controlling said variable force solenoid; a filter for filtering position signals of a rotating shaft; and an identifier for receiving the filtered position signal, identifying said VCT phaser state, and generate a reset signal to reset said control law.

DETAILED DESCRIPTION OF THE INVENTION

The present invention addresses the excessive long period of dead time in existing Variable Cam Timing closed-loop control system caused by internal integrator winding up. The invention teaches a method which solves the problem of winding up by learning the VCT phaser's physical travel limits while the engine is running. The method may be incorporated into a computer program product and implemented in a micro-controller such as an engine control unit (ECU). Furthermore, the present invention works in conjunction with any Variable Cam Timing control law as long as that control law utilizes integral action to eliminate steady-state tracking errors. Integral action is defined as the accumulation of error values by the control law.

Figure 3:
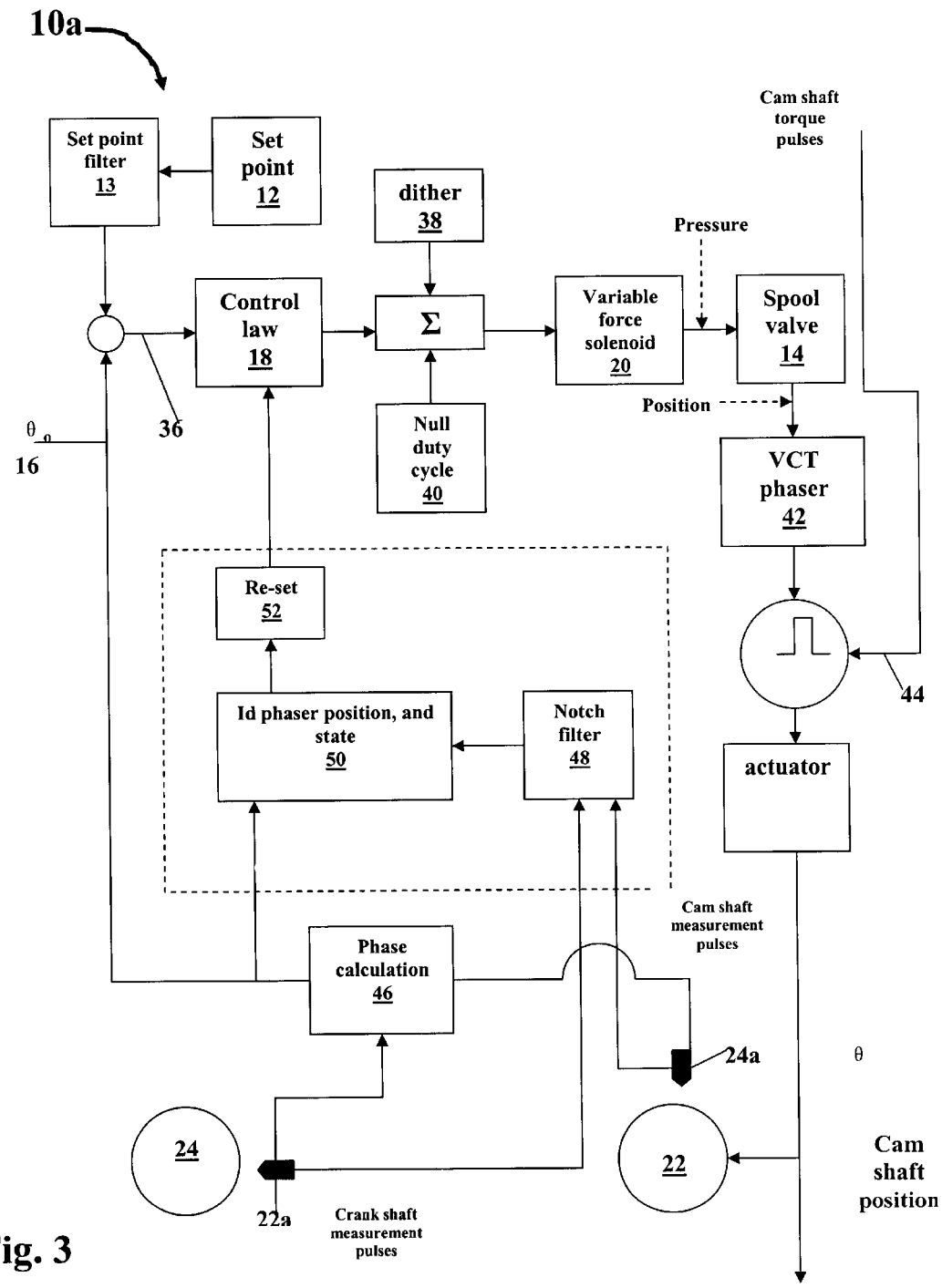
FIG. 3 shows a closed loop VCT system of the present invention.

A preferred system and method are shown in FIG. 3, wherein the control law 18 were described in U.S. Pat. No. 5,184,578, and phase measurement 26 was described in U.S. Pat. No. 5,289,805, both of which are hereby incorporated herein by reference.

Referring to FIG. 3, an overall control diagram 10*a* for a cam torque actuated variable cam timing (VCT) device and method incorporating the instant invention are shown. It is noted that some numbers in FIG. 3 corresponds with numbers of FIGS. 1 and 2 and are similar in function and character. A set point signal 12 is received from engine controller (not shown) and fed into set point filter 13 to smooth the sudden change of set point 12 and reduce overshoot in closed-loop control response. The filtered set point signal 12 forms part of an error signal 36. The other part that forms the error signal 36 is a measured phase signal 16 which will be further described infra. By way of example, the error signal 36 may be generated by subtracting the measured phase 16 from the filtered set point 12. At this juncture, the error signal 36 is subjected to control law 18.

The output of control law 18, in conjunction with dither signal 38 and null duty cycle signal 40, are summed up and form the input value to drive solenoid 20 which in this case may be a variable force solenoid. Dither signal 38 is disposed to overcome any friction and magnetic hysteresis of the solenoid 20 and spool valve 14. The null duty cycle 40 is the nominal duty cycle for the spool 14 to stay in its middle position (null position) whereby fluid-flow in either direction is blocked. The variable force solenoid 20 moves spool valve 14 which may be a center mounted spool valve to block the flow within VCT phaser 42 in either one direction or the other. Thus the VCT phaser 42 is enabled to move towards the desired direction under oscillating cam torque 44. When the VCT phaser 42 moves to a desired position which is predetermined by set point 12, the center mounted spool valve 14 would be driven to its middle position (null position), thereby the VCT phaser is hydraulically locked and stays thereat. If the set point 12 changes or the VCT phaser 42 shift away due to disturbance, the above process loops again.

The positions of the cam shaft and crankshaft are respectively sensed by sensors 22*a* and 24*a*. The sensors may be any type of position sensors including magnetic reluctance sensor that senses tooth position of the wheels 22 and 24 which are rigidly attached respectively to cam and crank shaft of a suitable internal combustion engine.

Figure 1:
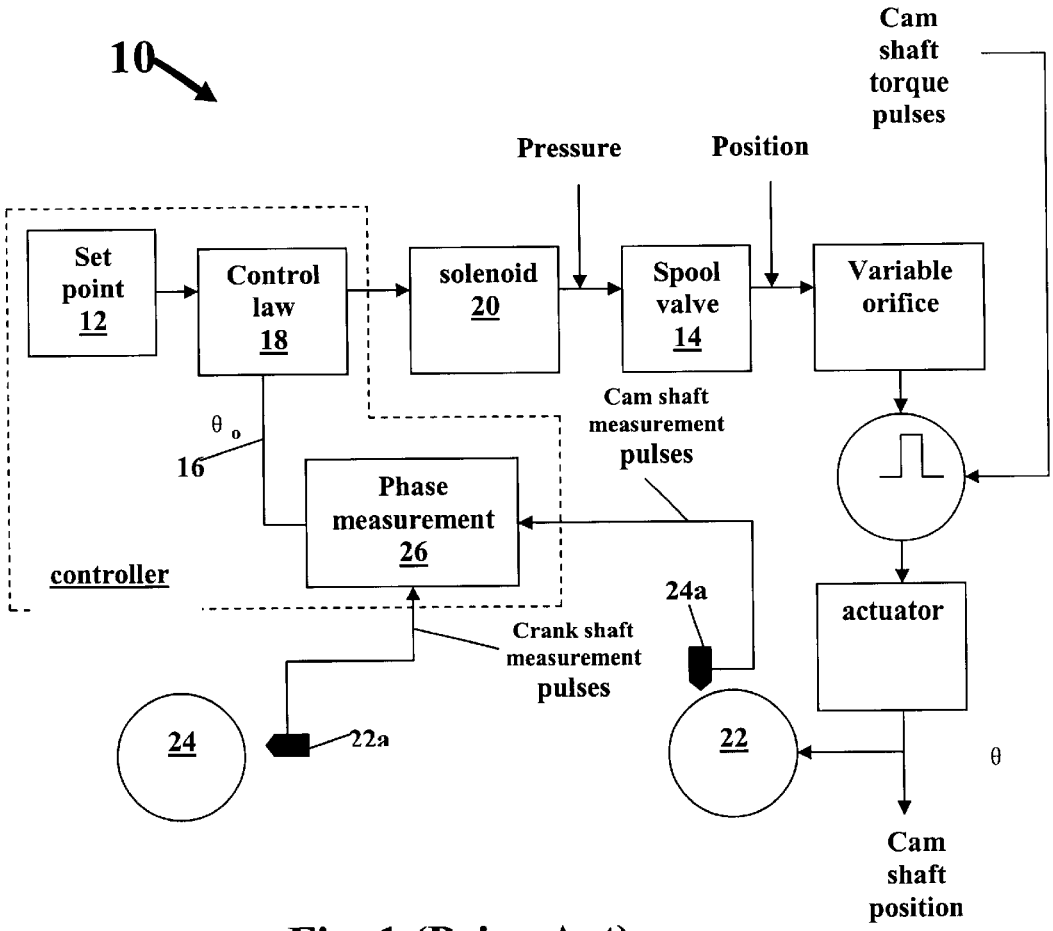
Fig. 1 (Prior Art)
FIG. 1 shows a prior art closed loop VCT system.

The sensed signals of position sensors 22 and 24 respectively are typically in the form of tooth pulses. The tooth pulses are initially filtered by a notch filter 48. The filtered tooth pulse or the filtered phase signal functions as one of the input to an identifying block 50. In block 50, a determination is made regarding whether the non-moving phaser 42 is at a stop or steady state. The other input to block 50 is the measured phase signal 46. It is pointed out that the prior art phase calculator 16 of FIG. 1 is the same as phase calculator 46. Based upon the two inputs, block 50 makes a determination which is described in detail infra. Under certain conditions, a reset signal 52 is generated to reset the control law 18.

Figure 4:
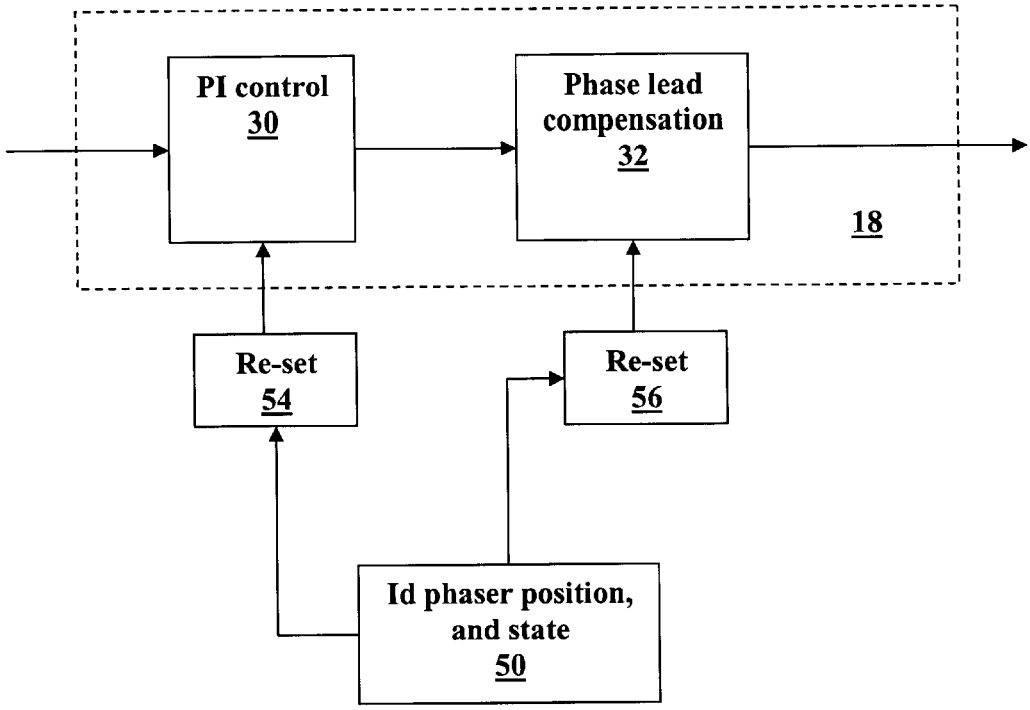
FIG. 4 shows a detailed portion of the closed loop VCT system of FIG. 3.

Referring to FIG. 4, a detailed depiction of the control law 18 in FIG. 3, is shown. Control law 18 is subdivided into PI control block 30 and phase lead compensation block 32. The reset function 52 of FIG. 3 is further subdivided into a first reset signal 54 for control block 30 and a second reset signal 56 for phase lead compensation block 32 respectively.

It should be pointed out that solenoid 34 may be of various types including pure electro-mechanical type, four way proportional solenoid type with hydraulic porting, or a solenoid with a built-in pulse width modulation (PWM) actuating valve. Further, as discussed supra, measured phase signal 16 forms part of the error signal 36. Measured phase signal 16 acts as a correction signal in this negative feedback loop.

By way of example, a present VCT control algorithm uses proportional-integrator controller 30 plus a lead compensator 32. The integrator 30 accumulates all the past error signals (i.e., the difference between the phase command signal 12 and measured VCT phase 16). The error signals are related to the solenoid current that drives the spool valve 14. Ideally, the integrator 30 output in the steady state is zero because the error signal is zero at the steady state. During transition, the positive and negative error signals cancel each other after integration. In reality, integrator 30 output may be a large enough value to move spool valve 14 during transition which is undesirable. At steady state, integrator 30 output remains a relative small value so that the spool valve 14 hysteresis can be overcome, thereby allowing spool valve spring force to offset any unbalancing force driving the spool away from the null position. Thus, a relative stable position of the spool valve is maintained.

Problems arise when the VCT phaser is commanded to move to a position beyond where it can physically go. If this occurs, there is always a difference between the command signal 12 and measured VCT phase 16. Thus the integrator output keeps increasing overtime and causes the so called integrator winding up phenomenon. The reason for the winding up is because the method of prior art, in and of itself, cannot stop calculating when the spool valve 14 physically stops. The instant invention addresses these issues, which include automatically learning an optimal upper limit and a lower limit as the case may be and stopping the calculations appropriately.

During any unstable state, spool valve 14 usually is pushed away from its null position by solenoid 20 as opposed to its staying right at null or steady state wherein no fluid flows between the chambers. As can be appreciated, if the phaser is commanded to move to the reverse direction after the spool valve has been pushed away from null position, the spool valve needs to move back, pass null, and move to the other side of null in order to open the flow passage for fluid to flow in that direction.

Similarly, the integrator 30 output is pulled back by the error signal 36 of the opposite sign back to null value, and continues to accumulate in that direction to generate the required value to move the spool valve 14. The time period that starts when the error signal 36 switches direction until the integrator output is driven back to null may be the dead time in the context of the VCT closed-loop control response curve shown during experiment. Typically, the more severe the integrator winds up or the smaller the error signal of the opposite sign, the longer the dead time would last.

As can be appreciated, although the physical limits of the phaser 42 may be accurate initially, they would not be valid after the chain is worn out and the chain stiffness changes, and other occurrences, etc. Fixed phaser travel limits determined initially are not enough to accommodate the possible physical limit variations during the whole VCT life span. An additional learning on the fly method is required to know where the physical limits are in order to avoid degraded closed-loop performances. In the present invention, the controller learns where the physical limits are when the engine is running. When the controller commands the VCT to move but finds the measured VCT phase does not change for a relative long period of time, then the phaser 42 may have already hit its physical stop. The recent measured extreme may be the actual physical stop, i.e., the maximum for the upper limit, and the minimum for the lower limit.

As discussed supra, integrator winding-up happens when the phaser 42 has already reached its physical traveling stops but is still commanded to move even further. An always-presented error signal 36 accumulates in the integrator 30 (i.e., integrator wind-up), which disturbs the normal operation of the above described control law 18 and degrade the VCT performance. The invention provides a method wherein the values PI controller 30 outputs are learned dynamically in that the values of PI controller output e1 at steady state and the physical stops of VCT phaser 42 are learned dynamically. The dynamic learning process is further described infra.

The method further teaches when to reset the integrator 30 and compensator 32 and disable the integral action when VCT phaser 40 approaches its stops. In addition, the method teaches an automatic way to self-correct the learned physical stops if they are determined to be wrong. In other words, the instant invention eliminates integrator winding up and provides better closed loop control at stops.

Figure 5:
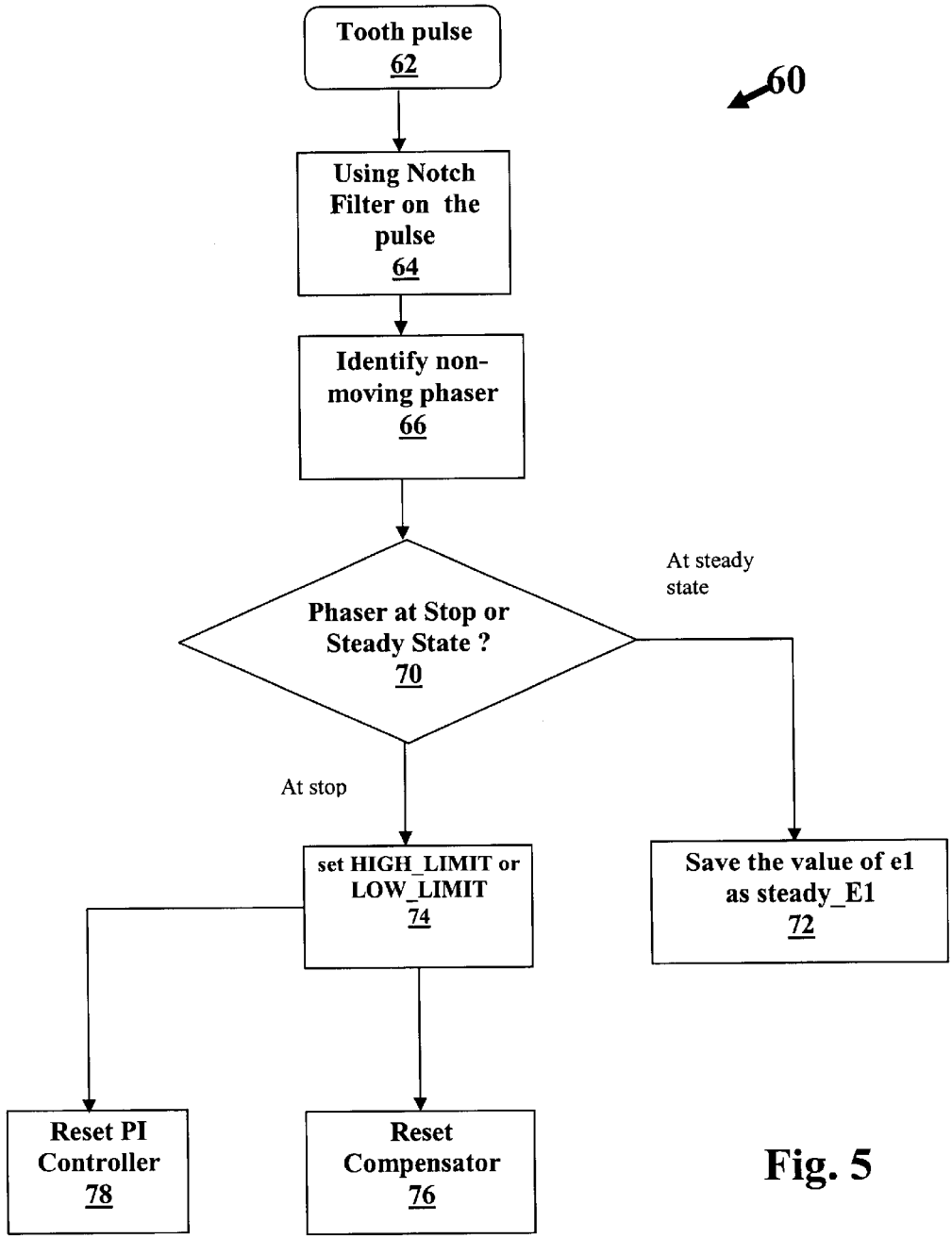
FIG. 5 shows a first flow chart depicting the present invention.

FIG. 5 shows a flow chart 60 of the instant invention. Tooth pulses are provided for processing (step 62). The provided tooth pulses are subjected to filtering by a notch filter (step 64). The filtered signals are identified for a determination as to whether a phaser is considered moving or non-moving (step 66). At this juncture, a measured phase signal also comes into the flow (step 68). A determination is made to determine whether the phaser is at a physical stop or a steady state (step 70). If it is determined that the phaser is at the steady state, the value of the current e1, or an output of PI controller, is saved (step 72). If the phaser is at a physical stop, the current positional value is considered to be either the high limit of the phaser, or the low limit of the same (74). The PI controller and a compensator of a control law are reset (steps 76, 78).

Figure 6:
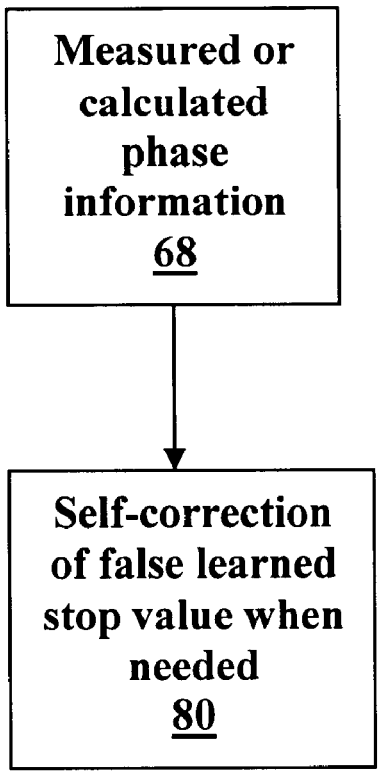
FIG. 6 shows a second flow chart depicting the present invention.

Referring to FIG. 6, the measured phase signal that comes into the flow (step 68) within flow chart (60) causes a self-correction of any previous mistakenly learned position values representing a physical stop (step 80).

Turning now to FIGS. 3–6, a detailed descriptions of individual groups of the instant invention is given.

Using Notch Filter to Remove Phase Oscillation Caused by Camshaft Torque Pulse (Step 62).

During engine operations, the engine camshaft is subjected to sinusoid torque and its speed oscillating around its nominal value. For example, the cam shaft torque pulse 44 of FIG. 3 may be such a sinusoidal torque. The pulse 44 includes a nominal value and some harmonics of the camshaft torque frequencies. A sequence of pulse 44 is continuously fed into a notch filter, such as notch filter 48, which operates to have the harmonics removed. The end result is a smoothed representation of the actual VCT phaser condition.

The general form of notch filter is $$y(n)=C0*u(n)+C1*u(n-1)+C2*u(n-2)+\ldots+Ck*u(n-k),$$

where y: output of notch filter, u: input of notch filter, n: the $n^{th}$ data or the latest data, k: number of updates (teeth) of one camshaft revolution, u(n-k): the input of k times of updates old, m: the primary order of camshaft torque frequency h: harmonics.

C: coefficient.

In a vector form, C0, C1, . . . , Ck can be written as $$D=[1, -2*\cos(m/k*2\pi), 1]'$$

$C=D/\mathrm{sum}(D)$ to remove the oscillation of the primary order only.

C can also be calculated in the following way to remove the oscillation of the primary order and its second harmonics (when h=2).

$$D=[1,-2*\cos(m/k*2\pi),1] \text{ convolute with } [1, -2*\cos(h*m/k*2\pi),1]$$

$$C=D/\text{sum}(D)$$

To remove higher order harmonics, one can simply convolute more times.

Also simple moving average may serve a similar purpose. Notch filter elements can be expressed as follows using more descriptive variable names:

$$\text{avgCamWidth}=(\text{CAMT0}+\text{CAMT1}+\ldots+\text{CAMT_}k-1)/k,$$

$$\text{avgCrankWidth}=(\text{NEPW}+\text{NEPW1}+\ldots+\text{NEPW_}k-1)/k,$$

$$\text{filteredPhase}=\text{avgCamWidth}/\text{avgCrankWidth}*720/k,$$

CAMT0~CAMT_k−1: difference between cam pulse edge and crank pulse edge,

NEPW~NEPW_k−1: the latest k crank pulse widths, k: preferred to be the number of teeth in camshaft toothwheel, or other number.

Identifying Non-Moving Phaser (Step 66)

After removing oscillation from the measured phase, an adaptive band technique is developed to identify the non-moving phaser. The adaptive band technique is further described infra. Starting from an initial filtered PHASE_0, and comparing the following filtered PHASE_i with PHASE_0, we have:

```
If | PHASE_i − PHASE_0 | < halfBandWidth within a certain
period of time
    Phaser is not moving
Else
    Phaser is moving
    Set PHASE_0 as PHASE_i
    Start a new identifying cycle
End
```

Phaser at Stop or Steady State (Step 70)

In the following two cases: phaser at stop and phaser at steady state, the phaser 42 is considered to satisfy the non-moving condition. Therefore, one needs to distinguish between the two cases. Integrator output, such as PI control 30 output, is used to make the distinction between the two. It is known for sure that in a middle range of phaser travel, if the phaser 42 is identified as not moving, then it must be in steady state. For a working definition of a middle range, the range between 15 to 38 degrees may be considered as the middle range in a 0 to 60 degree phaser. Furthermore, in the middle range, controller integrator output, such as PI control 30 output, is in a steady state value as well. The corresponding value, steady_E1, for a certain set of hardware is a constant under a given operating condition.

If the phaser is outside of the middle range of travel, the phaser has been identified as non-moving, and the output value of integrator 30 exceeds a certain threshold value such as E1_threshold, the phaser must be at stop.

The sign of the difference between the integrator output and steady_E1 indicates whether the phaser is at advanced stop or retarded stop.

The following shows the logic of a subroutine of step 74 of FIG. 5.

```
If phaser is at retarded stop
    HIGH_LIMIT = recent maximum measured phase
If phaser is at advanced stop
    LO_LIMIT = recent minimum measured phase
```

Prevent Integrator Winding-Up by Resetting Integrator and Compensator (Steps 76 and 78)

Now it is known that the actual phaser physical stop LO_LIMIT represents advanced stop and HIGH_LIMIT represents retarded stop. If the measured phase has already been close to the physical stops, and a controller command is still commanding the phaser to move, then reset the integrator to its steady state value steady_E1.

```
If measured phase < LO_LIMIT + threshold && set point < measured
phase,
                                or
measured phase > HIGH_LIMIT − threshold && set point > measured
phase
    Integrator coefficient Ki = 0
    Integrator state variable = steady_E1
    Set compensator output e2 to e1;
    set the state variable (running sum) in compensator as e0/(1-zlag)End
```

Self-Correction from False Stop Value Learning (Step 80 of FIG. 6)

The learning of phaser stop is a dynamic process. If for some reasons erroneous learning were generated, the following logic would correct the false learning automatically. This is one example of steps in FIG. 6.

```
If current measured phase < LO_LIMIT
    LO_LIMIT = current measured phase
If current measured phase > HIGH_LIMIT
    HIGH_LIMIT = current measured phase
```

The above shows a detailed embodiment of the flow charts depicted in FIGS. 5 and 6 of the present invention. The described invention is suitable to work in conjunction with any Variable Cam Timing control law as long as that control law utilizes integral action to eliminate steady-state tracking errors.

The present invention teaches a VCT control method suitable for computer implementation having Proportional-Integrator control and a lead compensator, the integrator accumulates all the past error signal (the difference between the phase command signal and measured VCT phase) and is related to the solenoid current that drives the spool valve. Ideally, the integrator output in the steady state is zero because the error signal is zero at the steady state, and during transition, the positive and negative error signals cancel each other after integration. In reality, it may be a large value during transition to move spool valve, and still retains a relative small value at steady state for such purposes as overcoming the spool valve hysteresis, balancing spool valve spring force offset, and maintaining spool valve at null position.

Problems occur when the VCT phaser is commanded to move to a position beyond where it can physically go. In this case, a difference between the command signal and measured VCT phase always exists. Thus, the integrator output keeps increasing overtime and causes the so called integrator winding up. Spool valve usually would be pushed away from its null position as opposed to its staying right at null at steady state. If the phaser is commanded to move to the other direction after spool valve has been pushed away from null position, the spool valve need move back, pass null, and move to the other side of null to open the flow passage for that direction. Similarly, the integrator output is pulled back by the error signal of the opposite sign back to null value, and continues to accumulate in that direction to generate the required value to move the spool valve. The time started from the error signal switches direction until the integrator output is driven back to null appears to be the dead time on VCT closed-loop control response curve(not shown). Generally speaking, the severer the integrator winds up or the smaller the error signal of the opposite sign, the longer the dead time.

Figure 7:
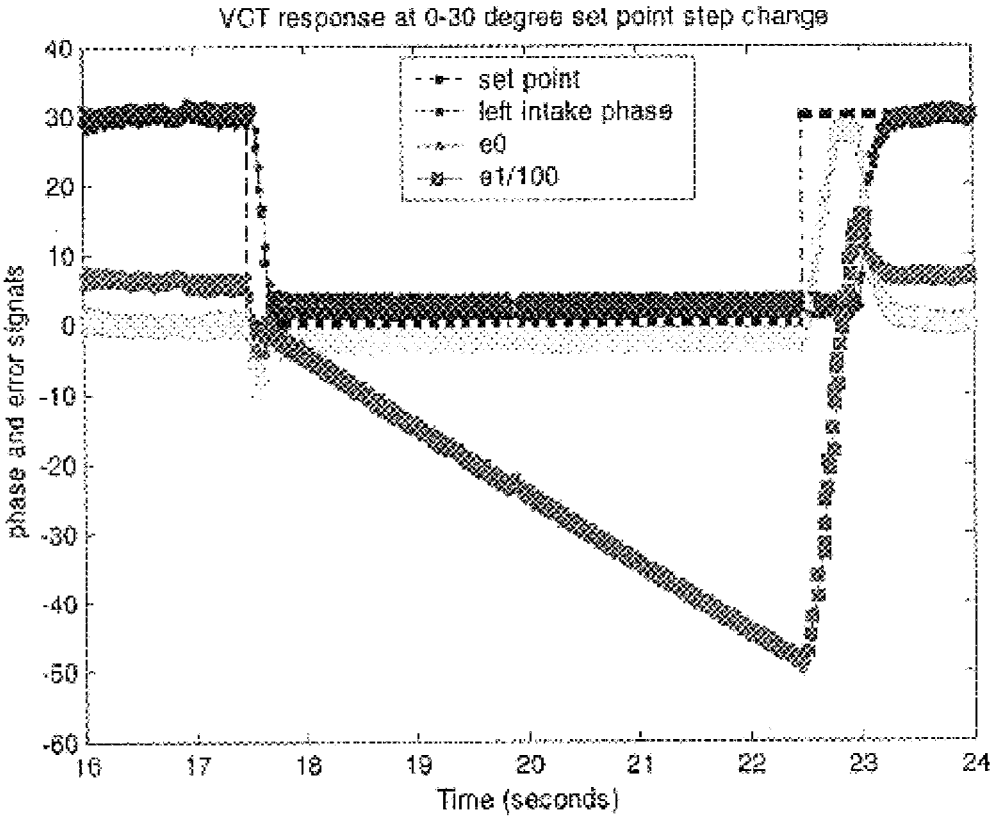
FIG. 7 shows an example of how the integrator output behaves and winds up when the VCT phaser is commanded to move to an unrealistic position.

FIG. 7 gives an example how the integrator output behaves and winds up when the VCT phaser is commanded to move to an unrealistic position. The unrealistic position is a position that cannot physically exist in that a vane is commanded to move toward an advance or retard position beyond where it can physically go.

The data in FIG. 7 is taken from an exemplified running test stand using a controller method suitable for computer implementation without integrator anti-winding up method. The numerical value of the lower physical limit is about 3 crank degrees. The VCT command position is 0 to 30 degrees square wave. The unit for set point, phase, and error 0 (e0) is in crank degrees. The unit for integrator output (error 1 divided by 100, or e1/100) is corresponding to 5 mA solenoid current. When the set point is 30 degrees (within the physical limits), the integrator output at steady state is about 35 mA. The integrator output keeps increasing when the set point switch to 0 degree while the lowest position the phaser could move is 3 degree. No harm has been done yet. But when the set point moves back to 30 degree, it takes about half a second for the integrator output to go back to its null value. During this half a second period, the phaser stays where it was and does not move at all, as opposed to its responding the set point changing within about 40 milliseconds when it was at 30 degree in this particular case.

The solutions to this problem are either never commanding the phaser to move beyond its physical limits or freeze the integrator when the set point is approaching or outside the phaser physical limits. For either case, we need to know exactly where the phaser physical limits are. The present invention teaches a method for the controller to learn the above phaser physical limits under certain conditions.

The phaser physical limits in other words are the relative angular displacement limits between the VCT housing sprocket and crank sprocket. Unfortunately, these limits are not fixed. A number of factors contribute to their variations. They may vary from engine to engine due to the manufacturing tolerance of VCT unit, variation of chain length, tensioner position, and phase measurement error. The strand length in a particular running engine may increases or decreases when the engine speed changes, timing chain resonance comes in or out, and chain wears out, etc. Experience has shown that the physical limits may follow these variations towards retard direction up to more than 5 crank degrees.

In addition, although the physical limits may be accurate initially, they would not be valid after the chain is worn out and the chain stiffness changes over time. Fixed phaser travel limits are not enough to accommodate the possible physical limit variations during the whole VCT life span. Therefore, an additional learning on the fly method suitable for computer implementation is required to know where the physical limits are in order to avoid degraded closed-loop performance. In the present invention, the controller learns where the physical limits are when the engine is running. When the controller commands the VCT to move but finds the measured VCT phase does not change for a relative long period of time, then the phaser must have already hit the physical stop. The recent measured extreme value is the actual physical stop, i.e.,—the maximum for the upper limit, and the minimum for the lower limit.

Identifying Non Moving Phaser

First, the micro-controller should be able to identify that the phaser is not moving. There should be a quantified range within which the measured phases stay. The range exists because in the real physical applications the phaser moves to overcome such effects as system hysteresis as described supra. The range should not be too large so that even when the phase stays within that range we are still not sure whether the phaser is moving under control or not. The range should also not be too strict so that when the phaser slightly drifts away from the stop, it would be considered as not-at-the-stop condition.

An immediate difficulty arises since the phaser always has oscillation excited by camshaft torque, which happens three times every cam revolution for a V6 engine. The peak to peak amplitude of oscillation varies from unit to unit, mostly depended upon the hydraulic leakage of the system. The peak-to-peak amplitude may be around four crank degrees or higher when engine speed is lower than 1000 rpm. We can not check the range of measured phases using the micro-controller directly although human eyes can tell the general trend by just looking at the raw measured phase only at post-processing. However, human eyes cannot be used in this application. If we can effectively get rid of the oscillation components in the measured phases introduced by torque pulse, it will be much easier to identify such range to define whether the phaser is moving or not.

Figure 2:
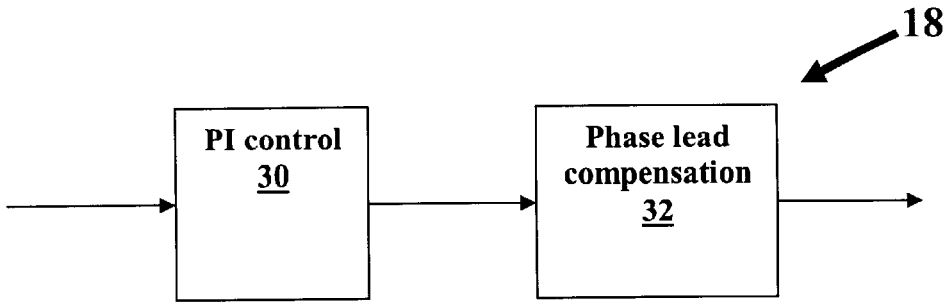
Fig. 2 (Prior Art)
FIG. 2 shows a prior art control law of the closed loop VCT system of FIG. 1.

The frequency of torque pulse introduced oscillation possesses a fixed ratio with respect to engine speed. Because of the above, the employment of a so-called notch filter serves the purpose of reducing noise. The notch filter is a digital filter designed to get rid of noise signals of a specific frequency component. In V6 engine with 8 teeth on camshaft, torque pulses introduced excitation occurs three times per cam revolution and cam measurement updates eight times per cam revolution. A 7th order notch filter may be used to get rid of the third order oscillation and its concomitant harmonics. The input of this notch filter should be the measured phase which is updated every time a cam pulse comes in. The time interval between two consecutive samples varies with respect to camshaft speed. Unfortunately, based upon experiment, most data collected in the past are not collected in the same fashion as notch filter in VCT controller would see because they have been re-sampled by the external data collection systems at a fixed sampling time interval of 10 milliseconds. Normally, these data can not be appropriately used to test the notch filter because the sampling time is not necessary equal to the cam tooth update time. There is only one exception though. At 1500 rpm, the time interval between two cam pulses is equal to 10 milliseconds the same time interval as the external data collecting system. Therefore, without running additional tests, those old data from 1500 rpm test can be fed into notch filter to test its performance, as shown in FIGS. 2 and 3.

Figure 8:
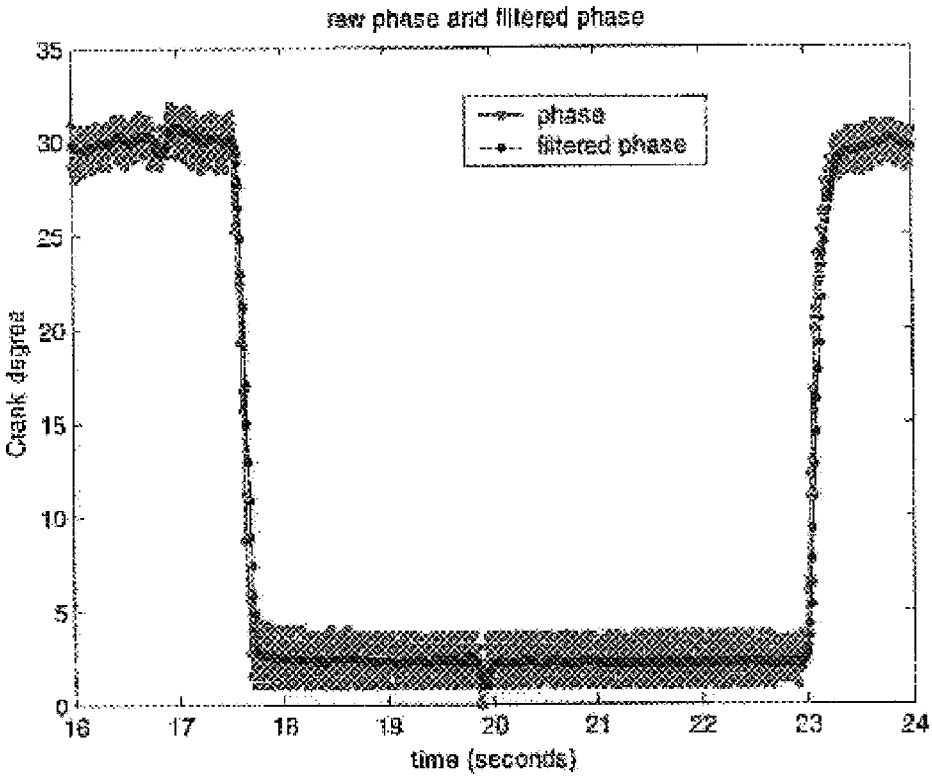
FIG. 8 shows a comparison between the raw phase data taken at an engine speed of 1500 rpm and the filtered data.
Figure 9:
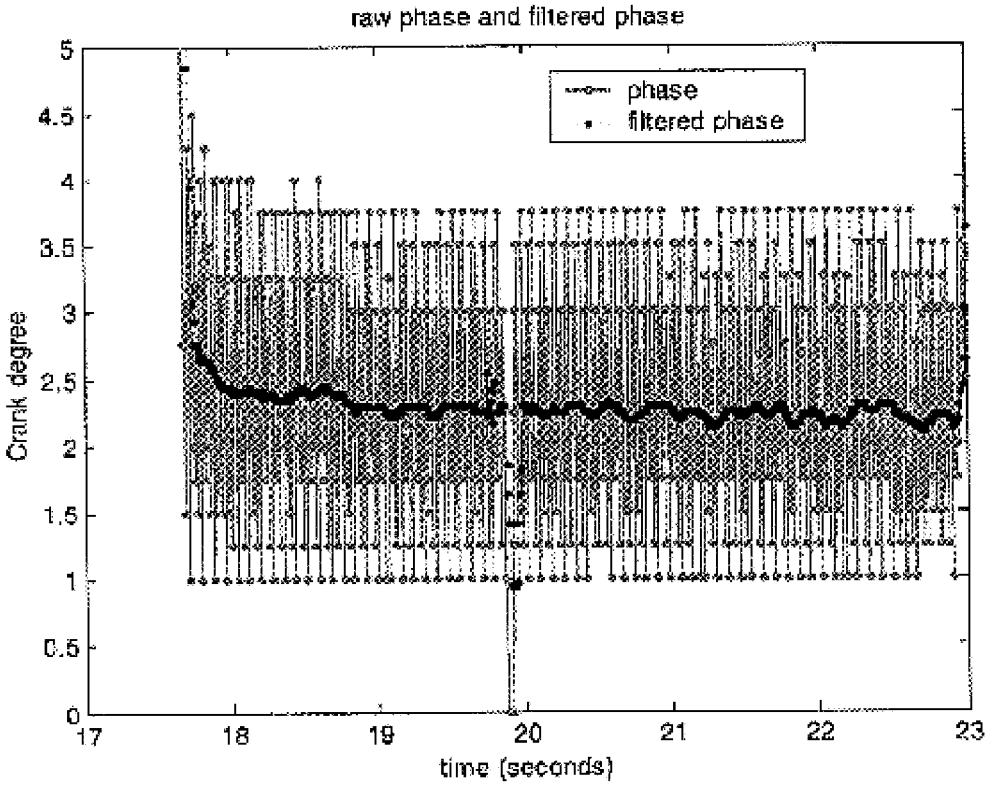
FIG. 9 shows a close-up look of FIG. 2.

FIG. 8 shows the comparison between the raw phase data taken at engine speed of 1500 rpm and the filtered data. FIG. 9 is a close-up look of FIG. 8. It is found that with this particular set of data, the filtered phase at stop varies within 0.25 crank degree while the raw phase data has peak to peak 2.75 crank degrees variation. As can be appreciated, the reduction from 2.75 to 0.25 degrees is very significant. In other words, the use of a suitable notch filter can reduce noise to a significant degree. It is noted that there may be erroneous readings such as erroneous phase readings due to disturbance. To be very conservative, one can choose two crank degrees as the range. Therefore, the VCT phaser is considered not to be moving if the difference between the maximum and the minimum of the filtered phase during a certain amount of time is smaller than two crank degrees.

An adaptive band technique is developed by the present invention to monitor one second of measurement and verify if the phaser is moving or not. This technique is illustrated in FIG. 4. To make the plot easy to read, only a ten-point band length is used. However, other suitable numbers can be applied subject the controller capabilities.

At the beginning of the ten-point session, the filtered phase is stored as ph0. Also a counter is set to one. Every new filtered phase is compared with ph0. If the new filtered phase is within one-degree range of ph0 (or within the band centered at ph0 with one degree of half-bandwidth), the counter is increased by one. When the counter reaches ten, one knows that during the past ten measured cam phases, the filtered phase stay within a plus/minus one-degree band. Therefore, the VCT phaser is considered to be either at its physical stop or at steady state. As can be appreciated, if we are able to tell that the VCT phaser is at its lower (high) physical stop, not at steady state, then we can pick the minimum (maximum) among the eight latest raw phases as the lower (upper) end VCT phaser limit. At the same time, reset the monitoring session by set ph0 to the tenth filtered phase, and reset the counter to one. If a new filtered phase is outside the band, the phaser is considered to be moving. At this juncture, terminate the current monitoring session by resetting ph0 to this particular filtered phase and resetting counter to one. A new monitoring session begins.

Figure 10:
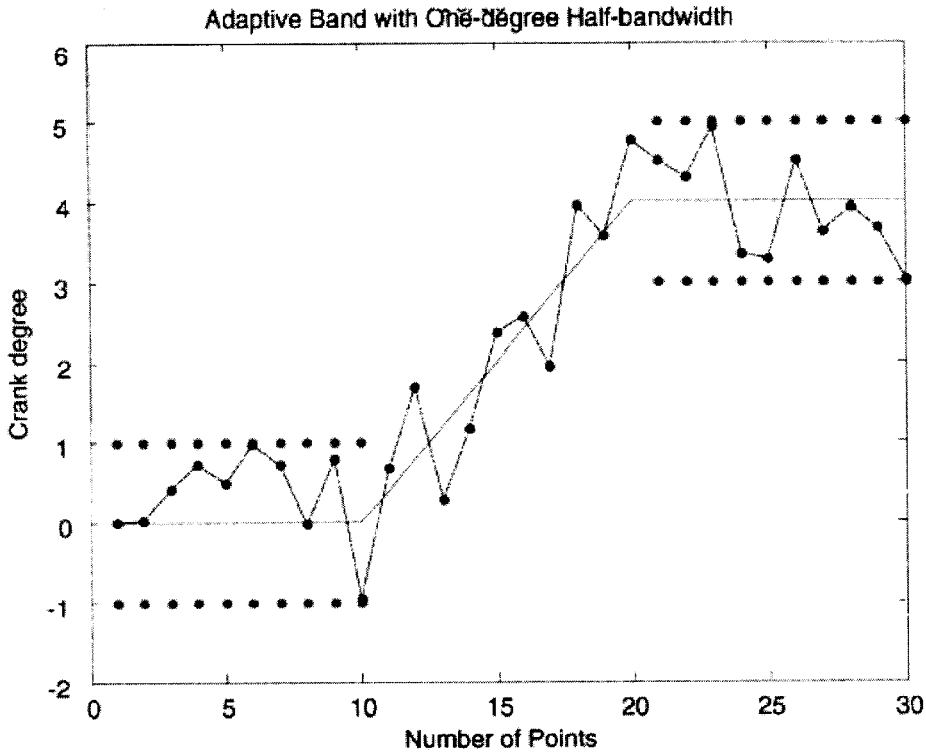
FIG. 10 shows an adaptive band with one-degree half bandwidth.

As shown in FIG. 10, the center line of the band can move with the filtered phase until it reaches a relative stable place and stays there. After a new signal or point is determined to be located outside the band, a new band is determined based on new data. In other words, the band moves in relation to new data. This is how the term of adaptive band is coined. An adaptive band can also tolerate the disturbance occasionally appearing in phase measurement as show in FIG. 9 around time of second 19.9. When that erroneous spike comes in, the centerline of the adaptive band would simply keep being reset until the erroneous signals pass away.

Phaser at Stop or at Steady State

Even if we can identify the non moving phaser, the phaser could either be at stop or at steady state if the phase set point has not been changed for a while. There must be additional information in order to distinguish these two situations. The use of the integrator output is a natural choice. As mentioned before, the integrator output at steady state is a relative fixed value. If the phaser is not moving during a certain period to time, and the integrator output stays around its steady state value, then the phaser is at steady state. Otherwise, the phaser is at stop.

For each individual VCT phaser, one needs to know what approximately the integrator output is at steady state. Ideally, the integrator output at steady state is zero. An offset is automatically generated when the controller is running so that the spool valve can overcome valve hysteresis, spool spring force offset, and VFS (variable Force Solenoid) solenoid performance variation, etc. The absolute numerical value converted into VFS current is usually smaller than 100 mA. However it may change with respect from unit to unit because of variations thereof and system aging. It is helpful to know the above value during the engine's initial calibration. However, one still has to know what the value is while the engine is running and after parts having been used and worn out. If the filtered phases fall into an adaptive band during a certain period of time and we are sure that the phaser is far away from the stop, the average value of integrator output is considered to be the integrator output at steady state. If the filtered phase is within plus/minus one-degree band and the average integrator output is 100 mA away from its steady state value, the phaser is considered to be at its stop.

Error Self-Correction

Since the present invention does not teach limiting the set point within the learned physical limits but rather teaches freezing the integrator, the phaser has the chance to go where it could possibly go, i.e., go to its real physical limits. If, after all the cautious procedure taken to prevent the false limit recognition, one still get an erroneous learned limits, one can restore the right value in several control loops by replacing the existing upper (lower) limits with the measured phase that is larger (smaller) than the output or result of the logic of self-correction.

The following is an implementation of an anti-wind up method suitable for computer application. It is for the VCT application in a V6 engine with 8 teeth at each camshaft. The left bank exhaust phaser is used as an example. The notch filter is implemented as an eight-point moving average and it would remove the third order camshaft oscillation and all its higher harmonics from the phase measurement. The naming convention is consistent with the program.

Find Filtered Phase

Global Variables:

NEPW, NEPW1, . . . , NEPW7: 2 bytes unsigned integer eight latest crank pulse widths, updated during crank interrupt routine, NEPW has already existed in current program (assume 4 crank teeth)

LCAMT0, LCAMT1, . . . , LCAMT7: 2 bytes unsigned integer

Eight latest pulse widths from crank edge to left cam edge, updated during Cam interrupt routine (assume 8 cam teeth):

| | |
|---|---|
| avgCamWidth_L_E: | average cam pulse width from crank edge to left cam edge, 2 bytes unsigned integer |
| avgCrankWidth: | average crank pulse width, 2 bytes unsigned integer |
| filteredPhase_L_E: | filtered left bank exhaust phase, 2 bytes unsigned integer |

Method Suitable for Computer Implementation for Notch Filter

```
// executed inside interrupt routine
avgCamWidth_L_E=(LCAMT0+LCAMT1+ . . . +LCAMT7)>>3
avgCrankWidth=(NEPW+NEPW1+ . . . +NEPW7)>>3
// executed in the control loop, call intdiv routine (the same as in prior art) to calculate phase
filteredPhase_L_E=intdiv (avgCamWidth LE, avgCrankWidth, ZPHASL)
```

Learning Method Suitable for Computer Implementation

Constant:

| | |
|---|---|
| E1_threshold = 1000 | // Integrator is considered to be winding up if its value<br>// is 10% duty cycle away from steady state output |
| halfBandWidth = 1 *4 | // Half band width is one degree, one degree is represented by 4 computer units in this computer program. |
| counterLength = 128 | // Choosing monitoring length as 2^7 * 0.01 = 1.28 sec |
| midLo = 15*4 | // Both up and lower exhaust phaser limits are assumed never |
| midUpE = 38*4 | // fall into the middle range of 15 to 38 degree calibrated |
| midUpI = 58*4 | // during engine start up, (15 to 58 degree for intake phaser) |

Global Variables for Left Bank Exhaust Phaser:

| | |
|---|---|
| LPHASE: | left exhaust phase |
| E1_L_E: | current error 1 |
| ZPHASL: | phase offset obtained in calibration |
| lo_limit_L_E: | phaser lower travel limit, 1 bytes unsigned integer |
| up_limit_L_E: | phaser up travel limit, 2 bytes unsigned integer |
| steady_E1_L_E: | current integrator steady state output, 2 bytes unsigned integer |
| centerLine_L_E: | current adaptive band centerline, 2 bytes unsigned integer |
| counter_L_E: | current adaptive band counter, 1 bytes unsigned integer |
| sum_E1_L_E: | running sum of error 1, 3 bytes |
| at_stop_L_E: | flag, 1: at stop, 0: not at stop, 1 byte |
| Temporary variable: | |
| avg_E1_L_E: | average Error 1 within a complete adaptive band, 2 bytes |

Method Suitable for Computer Implementation for Learning Limits

```
//Initialization right after phaser initial calibration:
lo_limit_L_E = ZPHASEL;
up_limit_L_E = ZPHASEL + 40;          // + 60 for intake
centerLine_L_E = filteredPhase_L_E;
counter_L_E = counterLength;
sum_E1_L_E = 0;
steady_E1_L_E = 0;
// All following logic is executed every control loop
if LPHASE > up_limit_L_E              // current phase > up limit
    up_limit_L_E = LPHASE;
    counter_L_E = counterLength;      // reset the counter
    return;
else if LPHASE < lo_limit_L_E         // current phase <
lower limit
    lo_limit_L_E = LPHASE;
    counter_L_E = counterLength;      // reset the counter
    return;
end if
// filtered phase is within +- 1 degree adaptive band
at_stop_L_E = 0;
if (filteredPhase_L_E <= centerLine_L_E + halfbandWidth) &
        (filteredPhase_L_E + halfBandWidth >= centerLine_L_E)
    sum_E1_L_E = sum E1_L_E +         //running sum for
    E1_L_E;                           error 1
    counter_L_E --;                   // decrease counter by 1
    if counter_L_E == 0               // complete 1.28 sec
                                      monitoring
    avg E1_L_E = sum E1_L_E<<7;       // obtain average integrator
                                      output
```

-continued

```
    if (filteredPhase_L_E >= midLo + ZPHASL) &
    (filteredPhase_L_E <= midUpE + ZPHASL)
        steady_E1_L_E = avg_E1_L_E;   // find integrator
                    steady state output
    else if (avg_E1_L_E >= steady_E1_L_E + E1 threshold)
        //, call intdiv routine (in prior art) to calculate phase
        up_limit_L_E = intdiv (max(LCAMT0, ..., LCAMT7),
                    avgCrankWidth, ZPHASL)
                        // set the recent maximal as the up limit
        at_stop_L_E = 1   // set at-the-stop flag
    else if (avg E1_L_E + E1_threshold <= steady_E1_L_E)
        call intdiv routine (in prior art) to calculate phase
        lo_limit_L_E = intdiv (min(LCAMT0, ..., LCAMT7),
                    avgCrankWidth, ZPHASL)
        // set the recent minimal as the lower limit at_stop_L_E = 1 //
set at-the-stop flag
            end if
            counter_L_E = counterLength;  // reset the counter after
                                          secession completed
            centerLine_L_E =                // reset the center line
            filteredPhase_L_E;              of the adaptive band
            sum E1_L_E = 0;
        end if
    else                                  // filtered phase is outside the
                                          adaptive band
        counter_L_E = counterLength;      // reset the counter
        centerLine_L_E =                  // reset the center line
        filteredPhase_L_E;                of the adaptive band
        sum E_1_L_E = 0;
end if
```

Using Learned Phaser Limit to Prevent Integrator Winding-Up

Constant:

PHS_INTEG_LIM=3*4

Threshold for resetting and freezing integrator and disabling compensator for both intake and exhaust, initial setting as 3 deg.

Method Suitable for Computer Implementation for Resetting Integrator (Within Control Law b)

```
Temp_Ki = Ki        // save the original Ki
If((LPHASE< lo_limit_L_E + PHS_INTEG_LIM) &&
(SETOUT <= LPHASE) || (LPHASE + PHS_INTEG_LIM >
up_limit_L_E) && (SETOUT >= LPHASE) ||
at_stop_L_E == 1)
    Ki=0;
    Set state variable (running sum) in control law b as steady_E1_L_E
End if
Call PI control law 30 as usual
Ki = Temp_Ki        // restore the original Ki
```

Method Suitable for Computer Implementation for Disabling Compensator (Within Compensate)

```
// After reset integrator, compensator must be disabled in that step in
    order to prevent abrupt change of // output e2 due to sudden change
    of input e 1.
If((LPHASE< lo_limit_L_E + PHS_INTEG_LIM) &&
    (SETOUT <= LPHASE) || (LPHASE + PHS_INTEG_LIM >
    up_limit_L_E) && (SETOUT >= LPHASE) || at_stop_L_E == 1)
    e2=e1;
    set the state variable (running sum) in compensator as    e0/(1-zlag)
else
    call compensator ( control law 32) as usual (the same way as in
    prior art)
end if
```

As can be seen, the present invention improves the control of a Variable Camshaft Timing (VCT) system near or at its physical stops, and avoids excessive dead time and performance deterioration caused by integrator winding-up. Integrator winding-up happens when the phaser has already reached its physical traveling stops and is commanded to move even further. An always present error signal (the difference between phase set point and measured phase) accumulates in the integrator (integrator wind-up). When winding up occurs, the integrator has to be emptied before producing the correct control signal. The phaser physical stops vary with parts tolerances, chain stretch, and chain wear out, etc. A static test can not be applied to accommodate the ever-changing values of the physical stops. By dynamically learning the integrator steady state output (null duty cycle offset) and the phaser physical stops and resetting the integrator and the compensator into its steady state value and doing proportional control only when the phaser approaches its stops, integrator winding-up is eliminated and a good closed-loop control of VCT at stops is realized. FIG. 5 shows a block diagram of the control method of the present invention.

Using Notch Filter to Remove Phase Oscillation Caused by Camshaft Torque Pulse

By passing recent measured pulse widths between the camshaft and the crankshaft through a notch filter, oscillation due to camshaft torque is removed from the measured phase. The filtered phase is used to judge the general trend of VCT movement. Assuming the camshaft uses an equally distributed tooth wheel, the following calculation removes all cam torque induced oscillation and its harmonics.

$$\text{avgCamWidth}=(\text{CAMT0}+\text{CAMT1}+\ldots+\text{CAMT_}n-1)/N$$

$$\text{avgCrankWidth}=(\text{NEPW}+\text{NEPW1}+\ldots+\text{NEPW_}n-1)/N$$

$$\text{filteredPhase}=\text{avgCamWidth}/\text{avgCrankWidth}*720/N-\text{Zphase}$$

Parameters

| | |
|---|---|
| CAMT0~CAMT_n-1: | difference between cam pulse edge and crank pulse edge |
| NEPW~NEPW_n-1: | latest crank pulse width |
| Zphase: | initial phase offset between crank and cam tooth wheel |
| N: | number of teeth in camshaft tooth-wheel |

Identifying Non-Moving Phaser

After removing oscillation from the measured phase, the adaptive band technique identifies the non-moving phaser. Starting from an initial filtered PHASE_0, and comparing the following filtered PHASE_i with PHASE_0.

```
If | PHASE_i −PHASE_0 | < halfBandWidth within a certain period
of time
    Phaser is not moving
Else
Phaser is moving
    Set PHASE_0 as PHASE_i
    Start a new identifying cycle
End
```

Phaser at Stop or Steady State

Both the phaser at stop and the phaser at steady state satisfy the non-moving condition. Integrator output is used to make the distinction between these two cases. One knows for sure that in the middle range of phaser travel, if the phaser is identified as not moving, it (the phaser) must be in steady state. At this juncture, the controller integrator output is in a steady state value as well, and its (the output's) value steady_E1 for a certain set of hardware is a constant for a given operating condition. Outside of that middle range of travel, if the integrator output of a non-moving phaser is far away from steady_E1 and exceeds a certain threshold E1_threshold, then the phaser must be at stop. The sign of difference between the integrator output and steady_E1 tells whether the phaser is at advanced stop or retarded stop.

```
If phaser is at retarded stop
    HIGH_LIMIT = recent maximum measured phase
If phaser is at advanced stop
    LO_LIMIT = recent minimum measured phase
```

Prevent Integrator Winding-Up by Resetting Integrator and Compensator

Now we know the actual phaser physical stop LO_LIMIT for advanced stop and HIGH_LIMIT for retarded stop. If the measured phase has already been close to the physical stops, and the command is asking the phaser moving further, then reset the integrator to its steady state value steady_E1 and disable compensator

```
If measured phase < LO_LIMIT + threshold && set point < measured
    phase, or measured phase > HIGH_LIMIT − threshold && set
    point > measured phase
    Integrator coefficient Ki = 0
    Integrator state variable = steady_E1
    //Disable compensator at this step in order to avoid abrupt
        change of compensator output.
    Set compensator output e2 to e1;
    set the state variable (running sum) in compensator as    e0/(1-zlag)
End
```

Self-Correction from False Stop Value Learning

Learning the phaser stop is a dynamic process. If for some reason erroneous learning was generated, the following logic would correct the false learning automatically.

```
If current measured phase < LO_LIMIT
    LO_LIMIT = current measured phase
If current measured phase > HIGH_LIMIT
    HIGH_LIMIT = current measured phase
```

Figure 11:
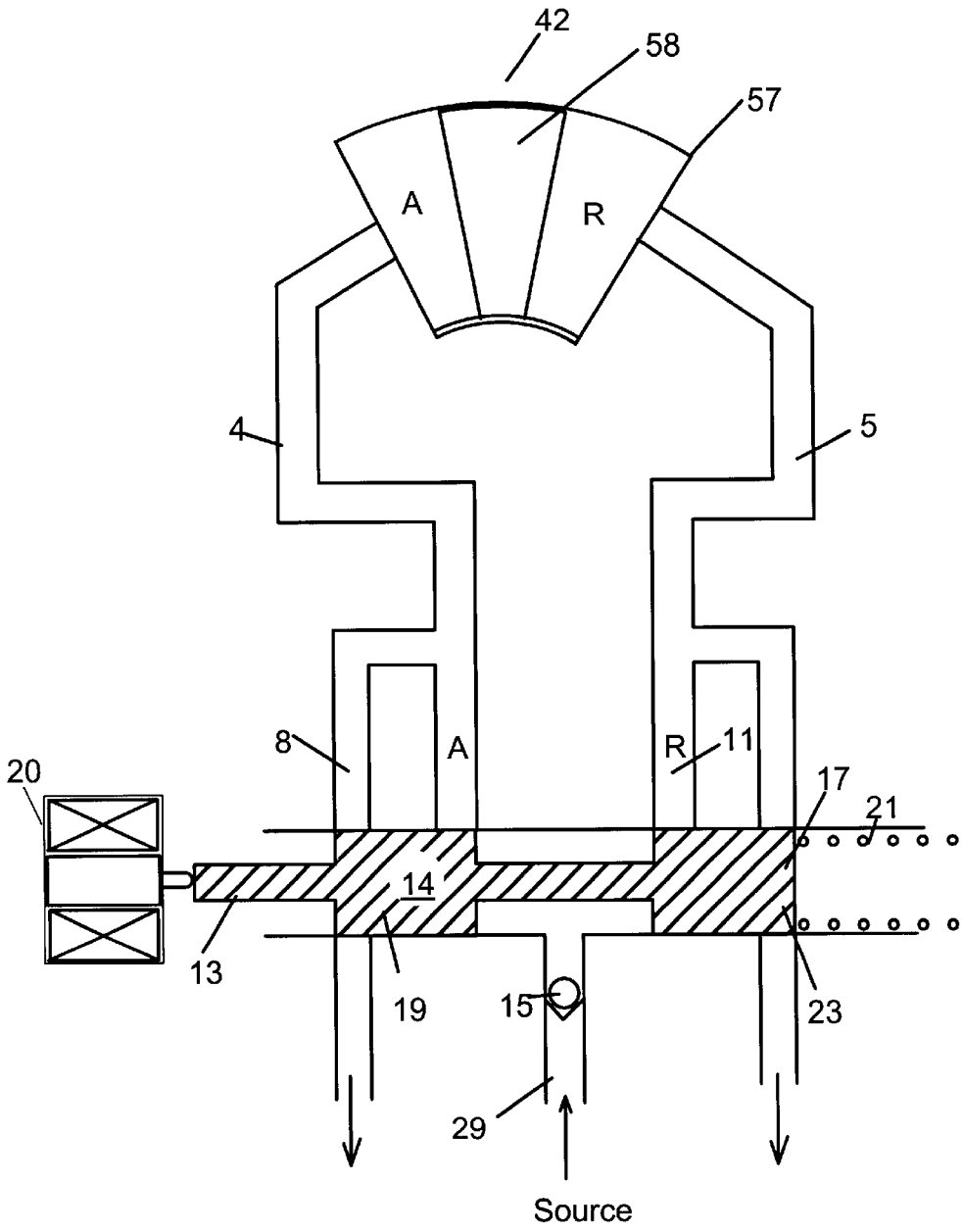
FIG. 11 shows a diagram depicting a physical relationship described in previous Figs.

FIG. 11 is a schematic depiction that shows, in part, the physical relationship of the previous Figs. A null position is shown in FIG. 11. Solenoid 20 engages spool valve 14 by exerting a first force upon the same on a first end 29. The first force is met by a force of equal strength exerted by spring 21 upon a second end 17 of spool valve 14 thereby maintaining the null position. The spool valve 14 includes a first block 19 and a second block 23 each of which blocks fluid flow respectively.

The phaser 42 includes a vane 58, a housing 57 using the vane 58 to delimit an advance chamber A and a retard chamber R therein. Typically, the housing and the vane 58 are coupled to the crank shaft (not shown) and the cam shaft (also not shown) respectively. Vane 58 is permitted to move relative to the phaser housing by adjusting the fluid quantity of advance and retard chambers A and R. If it is desirous to move vane 58 toward the retard side, solenoid 20 pushes spool valve 14 further right from the original null position such that liquid in chamber A drains out along duct 4 through duct 8. The fluid further flows or is in fluid communication with an outside sink (not shown) by means of having block 19 sliding further right to allow said fluid communication to occur. Simultaneously, fluid from a source passes through duct 13 and is in one-way fluid communication with duct 11 by means of one-way valve 15, thereby supplying fluid to chamber R via duct 5. This can occur because block 23 moved further right causing the above one-way fluid communication to occur. When the desired vane position is reached, the spool valve is commanded to move back left to its null position, thereby maintaining a new phase relationship of the crank and cam shaft.

As can be seen in FIG. 11, if vane 58 is commanded to move beyond its physical confines within housing 57, winding up occurs. The reason is that the controller (not shown) cannot determine the physical confines or stops by looking at the thing as a human being can. Therefore a method and system needs to be provided for the controller to determine the physical stops as described by the present invention.

One embodiment of the invention is implemented as a program product for use with a computer system such as, for example, the schematics shown in FIGS. 3 and 4 and described below. The program(s) of the program product defines functions of the embodiments (including the methods described below with reference to FIGS. 5 and 6) and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); and (iv) information conveyed to a computer by a communications medium, such as through a computer or telephone network, including wireless communications, or a vehicle controller of an automobile. Some embodiments specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of controlling a variable cam timing system comprising a phaser having a range of travel between a plurality of physical stops defining limits of rotational travel, wherein when the phaser is rotated to one of the physical stops, the phaser is at an extreme of its range of travel, such that the phaser can no longer move any further in one direction, comprising the steps of:

a) providing a set of tooth pulses from camshaft and crankshaft position sensors;

b) filtering said set of tooth pulses;

c) analyzing the filtered tooth pulses to determine whether the phaser is moving or not moving;

d) determining that the phaser is rotated to one of the physical stops when the phaser is not moving and an output of a phaser controller is commanding the phaser to move; and e) storing a position representative of at least one physical stop of said phaser.

2. The method of claim 1 further comprising the step of setting a high limit or a low limit when the phaser has reached one of the positions stored in step (e).

3. The method of claim 2 further comprising resetting a compensator.

4. The method of claim 2 further comprising resetting a PI controller.

5. The method of claim 1, wherein said filtering step includes the substep of using a notch filter for reducing noise level.

6. A variable cam timing feed-back control system, comprising:

a) a variable force solenoid;

b) a spool valve capable of being engaged by said solenoid;

c) a variable cam timing phaser having a range of travel between a plurality of physical stops defining limits of rotational travel, wherein when the phaser position is rotated to one of the physical stops, the phaser is at an extreme of its range of travel, such that the phaser can no longer move any further in one direction, disposed to determine a set of positions, wherein a set of relationships between a crank shaft and cam shaft is determined, said variable cam timing phaser being controllable by positions of said spool; and d) a controller including:

a control law disposed to receive a set point and capable of controlling said variable force solenoid;

a filter for filtering position signals of a rotating shaft;

an identifier for receiving the filtered position signal, identifying a signal representative of a position of the phaser from the position signals and generating a reset signal to reset said control law; and an output, wherein the phaser is rotated to one of the physical stops when the phaser is not moving and the output is commanding the phaser to move.

7. The system of claim 6, wherein said set point is filtered.

8. The system of claim 6, wherein said control law includes a PI controller and a phase compensator each disposed to be reset separately.

* * * * *